US010508519B2

(12) United States Patent
Pendleton et al.

(10) Patent No.: US 10,508,519 B2
(45) Date of Patent: Dec. 17, 2019

(54) FLOW THROUGH TREATMENT STRING FOR ONE TRIP MULTILATERAL TREATMENT

(71) Applicant: BAKER HUGHES, A GE COMPANY, LLC, Houston, TX (US)

(72) Inventors: Bryan P. Pendleton, Cypress, TX (US); Joseph E. Sheehan, Cypress, TX (US); John Vu, Houston, TX (US); Shannon Martin, Huffman, TX (US); Deshuttaney Mosley, Houston, TX (US); Mark J. Knebel, Tomball, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 171 days.

(21) Appl. No.: 15/334,925

(22) Filed: Oct. 26, 2016

(65) Prior Publication Data

US 2018/0112497 A1 Apr. 26, 2018

(51) Int. Cl.

| | |
|---|---|
| ***E21B 41/00*** | (2006.01) |
| ***E21B 23/12*** | (2006.01) |
| ***E21B 43/26*** | (2006.01) |

(52) U.S. Cl.

CPC ..... *E21B 41/0035* (2013.01); *E21B 23/002* (2013.01); *E21B 43/26* (2013.01)

(58) Field of Classification Search

CPC ... E21B 23/03; E21B 41/0035; E21B 41/0042
See application file for complete search history.

(56) References Cited

U.S. PATENT DOCUMENTS

| | | | | |
|---|---|---|---|---|
| 3,129,764 | A * | 4/1964 | Stein | E21B 21/10 166/327 |
| 7,128,146 | B2 | 10/2006 | Baugh et al. | |
| 8,985,203 | B2 | 3/2015 | Stokes et al. | |
| 2004/0149444 | A1* | 8/2004 | Cavender | E21B 41/0042 166/313 |
| 2016/0245046 | A1* | 8/2016 | Butler | E21B 23/002 |
| 2017/0152726 | A1* | 6/2017 | Ross | E21B 37/00 |

* cited by examiner

*Primary Examiner* — Robert E Fuller
*Assistant Examiner* — Lamia Quaim
(74) *Attorney, Agent, or Firm* — Shawn Hunter

(57) ABSTRACT

An adjustable tubular string nose uses axially relatively movable wedge segments to form a variable diameter ring shape using technology described in U.S. Pat. No. 7,128,146 in another context. The nose has a seat around a passage therethrough. After insertion of the nose into a first bore, typically a main bore, the nose is retracted out of the main bore and pressure against a seated bore in the nose expands the nose radially to a degree where re-entry into the main bore is precluded but entry into a lateral bore is still possible. The string advances onto a lateral no-go. This signals surface personnel to pick up and raise pressure to blow the seated ball through the seat to again open the passage in the nose. A seal stack behind the nose in advanced into a lateral seal bore and the treatment can then commence.

9 Claims, 6 Drawing Sheets

FLOW THROUGH TREATMENT STRING FOR ONE TRIP MULTILATERAL TREATMENT

FIELD OF THE INVENTION

The field of the invention is wellbore treatment and more particularly treating connected bores sequentially in a single trip such as through a multilateral junction.

BACKGROUND OF THE INVENTION

A variety of borehole treatments involve pressure pumping into adjacent segments of a zone to enhance future production from the zone. One such treatment is fracturing where a sequence of balls are dropped on seats that get progressively larger and pressure is applied to each landed ball to force fluid into the formation. At the end of the treatment the seats are milled out before production starts. In multilateral applications in the past the string had to be configured to go into a main bore and then pulled out so that its leading end would direct the string to go into a lateral bore or a separate diverting tool was installed in the junction to positively guide the string into a selected bore. This was a time consuming process for the trip out of and back into the hole. To save this trip a nose design was developed that can change diameter that would allow the string to enter one bore or another without a trip out of the hole or the deployment of accessory diverting tools. This design is shown in U.S. Pat. No. 8,985,203 where a piston in the nose is actuated axially to push out a coil spring to a larger dimension which would dictate the direction the string would advance as between bores. This design suffered from an inability to flow through the nose forcing the use of some other arrangement to get flow into the selected bore. Furthermore use of such a device in a fracturing application that involved a sequence of balls dropped on ever increasing diameter ball seats was also precluded as the central bore was obstructed.

The present invention addresses the shortcomings of the above design by combining a flow through design that can be selectively actuated to enlarge the diameter of the nose for direction of the string into a different bore and that further combines a seal assembly and a no-go feature to alert surface personnel that the seal bore in the second location has been reached. This allows the flowpath through the nose to be reopened so that the seal stack can be advanced into the second seal bore for treatment of the second bore including the ability to drop sequentially increasing diameter balls to fully treat a zone in discrete segments. These and other aspects of the present invention will be more readily apparent from a review of the description of the preferred embodiment and the associated drawings while recognizing that the full scope of the invention can be determined from the appended claims.

SUMMARY OF THE INVENTION

An adjustable nose for a tubular string uses axially relatively movable wedge segments to form a variable diameter ring shape using technology described in U.S. Pat. No. 7,128,146 in the context of a compliant swage device for tubular expansion. The nose has a seat around a passage therethrough. After insertion of the nose into a first bore, typically a main bore, the nose is retracted out of the main bore and pressure against a seated bore in the nose expands the nose radially to a degree where re-entry into the main bore is precluded but entry into a lateral bore is still possible. The string advances into the lateral until a no-go is reached. This signals surface personnel to pick up and raise pressure to blow the seated ball through the seat to again open the passage in the nose. A seal stack behind the nose is advanced into a lateral seal bore and the treatment can then commence into the lateral without pulling out of the hole after treating the main bore by simply landing the same seal stack in a seal bore in the main bore.

DETAILED DESCRIPTION OF THE PREFERRED EMBODIMENT

Figure 1:
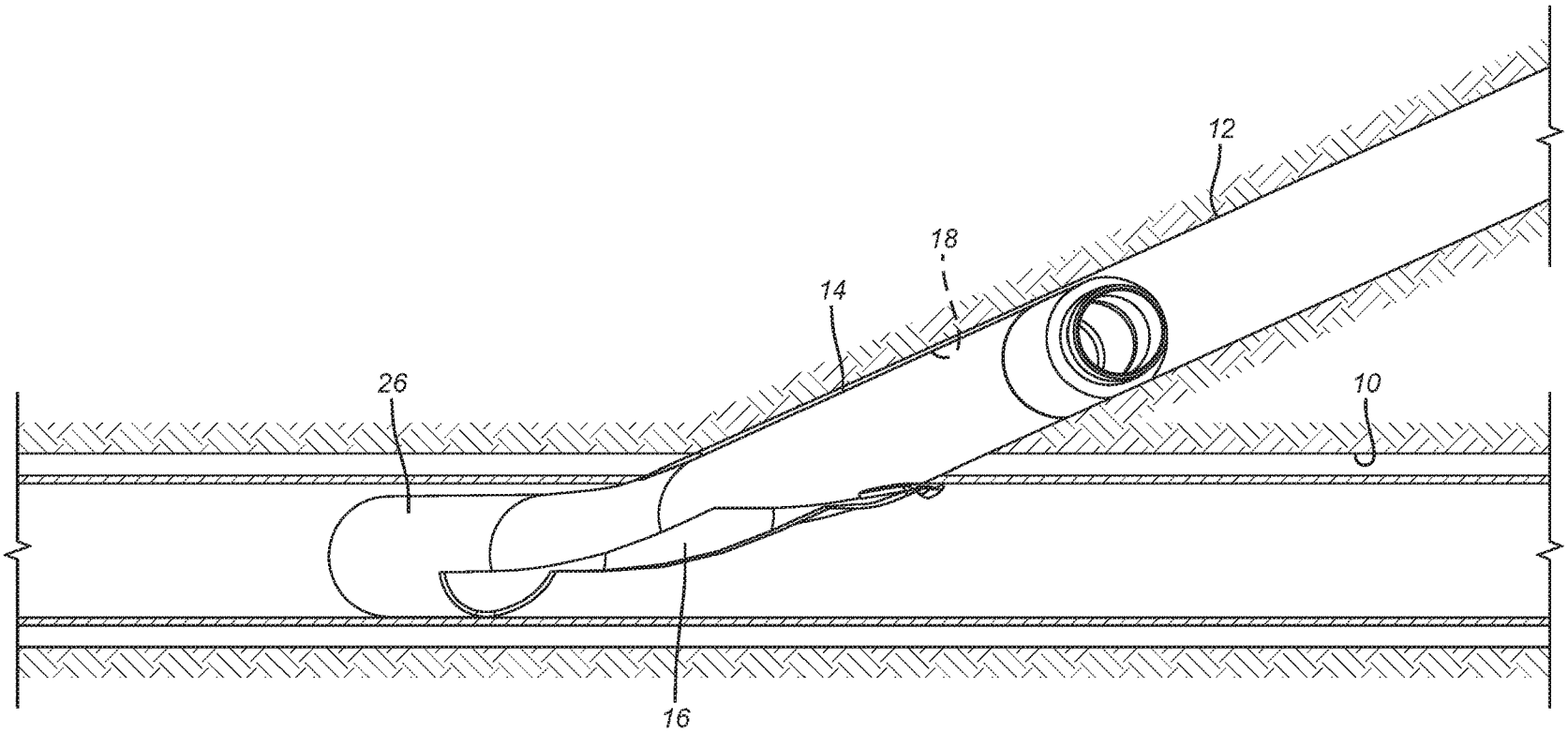
FIG. 1 illustrates a diverter that connects a main bore and a lateral bore.
Figure 4:
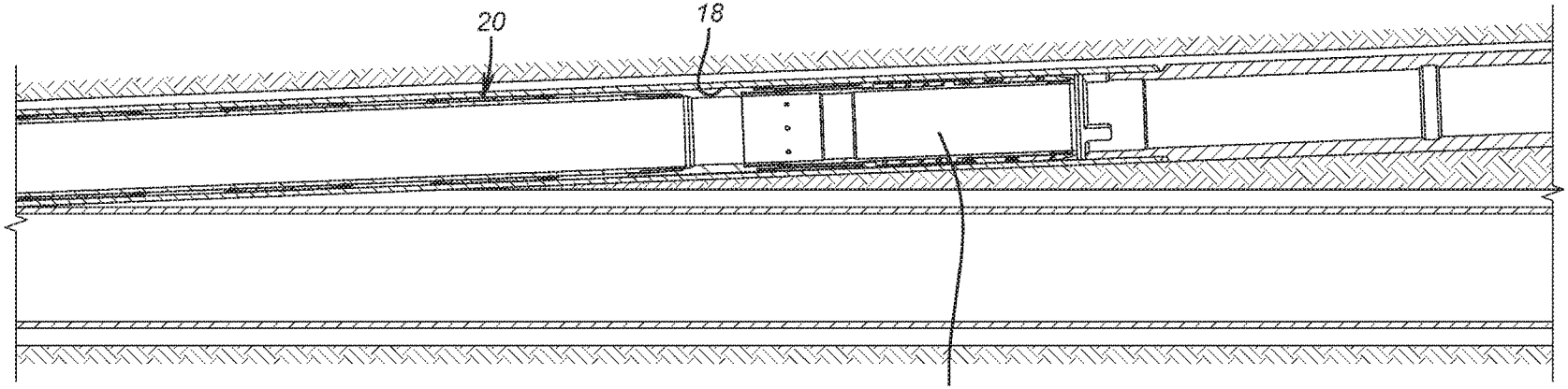
FIG. 4 is the view of FIG. 3 with the nose of the string in its smallest configuration, the passage in the nose open and the nose advanced into the lateral to a second no-go location where the seal stack is in the seal bore.
Figure 5:
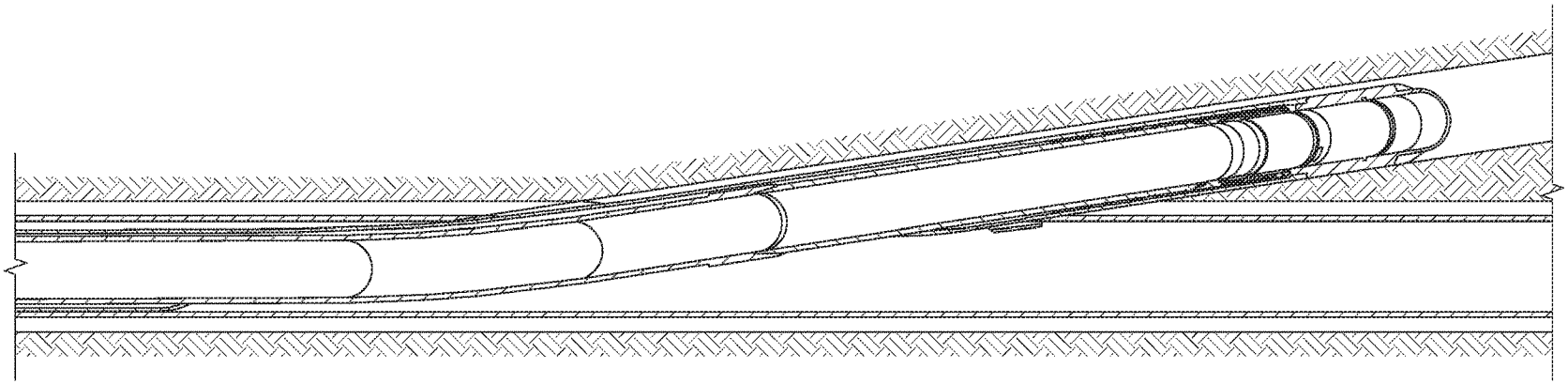
FIG. 5 is a perspective view of FIG. 4.

Referring to FIG. 1, a main bore 10 and a lateral bore 12 intersect at a diverter 14. Diverter 14 has an opening 16 that provides access from uphole to the main bore 10. Inside diverter 14 and in lateral 12 is a seal bore 18. The main bore 10 also has a seal bore that is not shown. Each of these seal bores are sized to engage a seal stack 20 best seen in FIG. 4.

Figure 2:
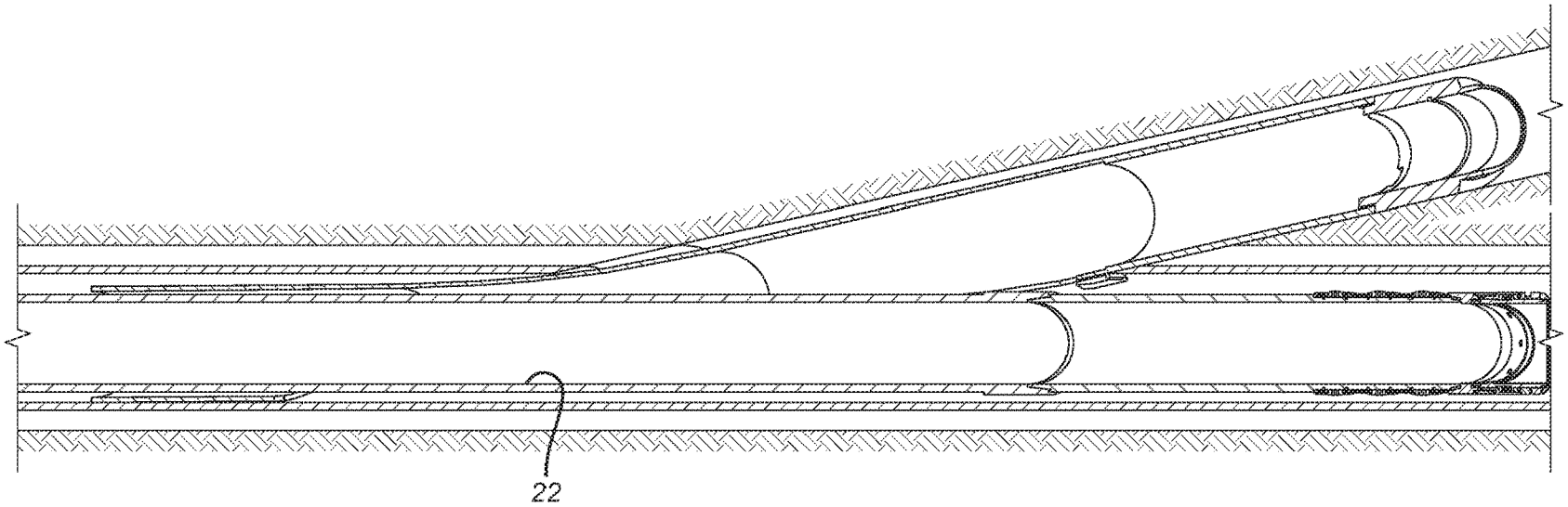
FIG. 2 is the view of FIG. 1 with a string advanced into a main bore.

A tubular string 22 has a nose assembly 24 at its leading end. In FIG. 2 the nose assembly is at its smaller radial dimension and as a result can advance through opening 16 and into main bore 10. String 22 is further advanced beyond the FIG. 2 position until a no-go is reached usually in a packer and adjacent to a seal bore that is not shown in such a packer. At the time the no-go position is reached the seal stack 20 will fit within the seal bore in main bore 10 so that a treatment operation can be undertaken in the main bore. This could be acidizing or fracturing that can be accomplished in a variety of ways including dropping progressively larger balls until each seats and raising the pressure to force fluid into segments of a zone in an uphole sequential manner that is known in the art. Other operations can be performed all of which are referred to as treatment and involve pumped fluid under pressure.

Figure 3:
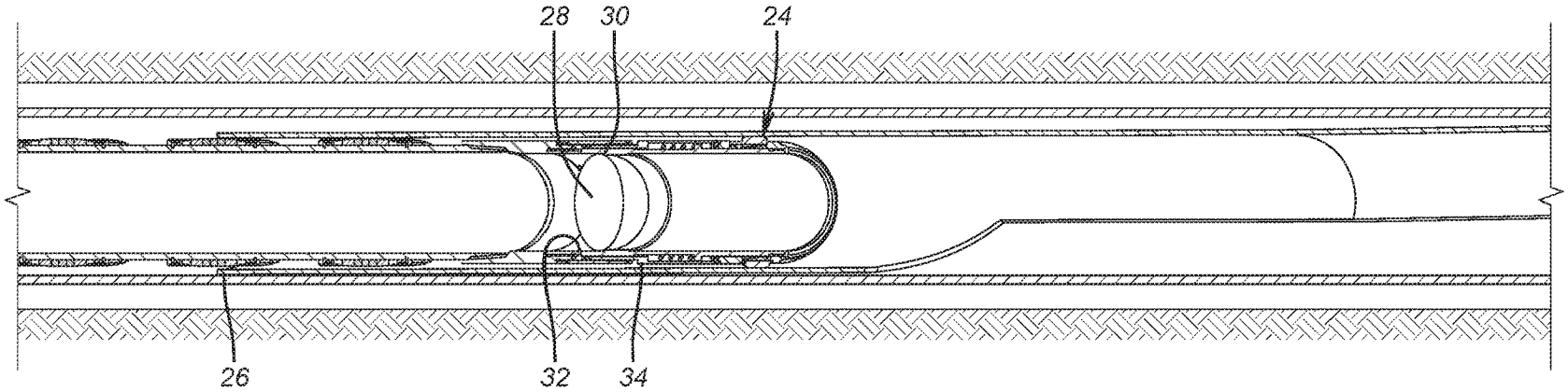
FIG. 3 is the view of FIG. 2 with the nose of the string retracted above the opening into the lateral and a seated ball to allow developed pressure to enlarge the diameter of the nose.
Figure 3A:
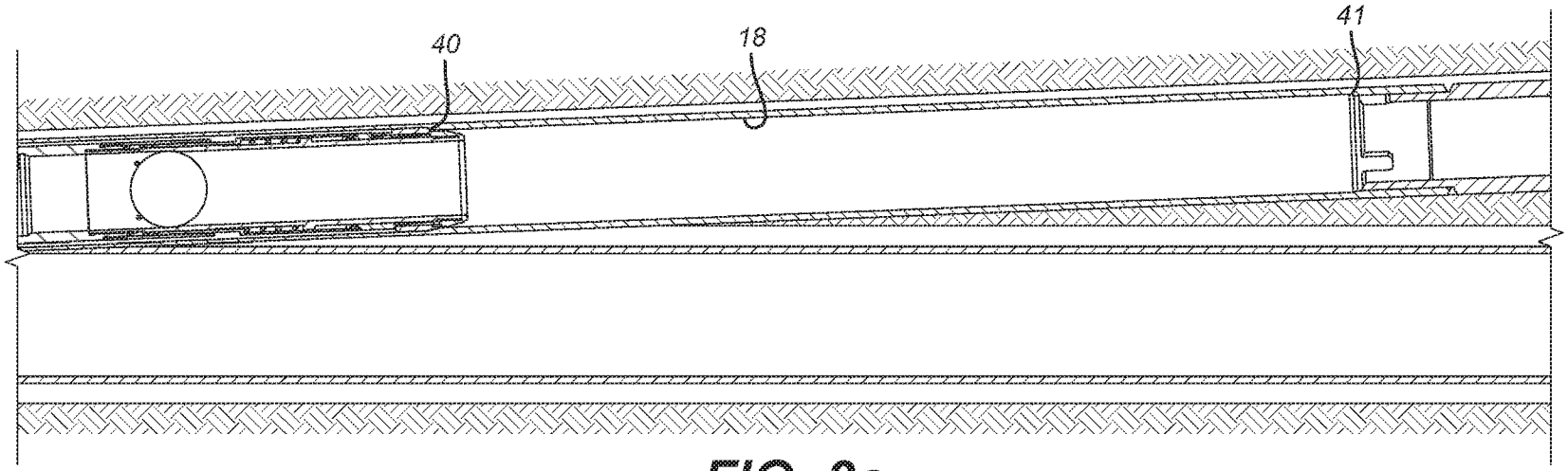
FIG. 3*a* is the view of FIG. 3 with the nose hitting a first no go while in the larger diameter position.
Figure 6:
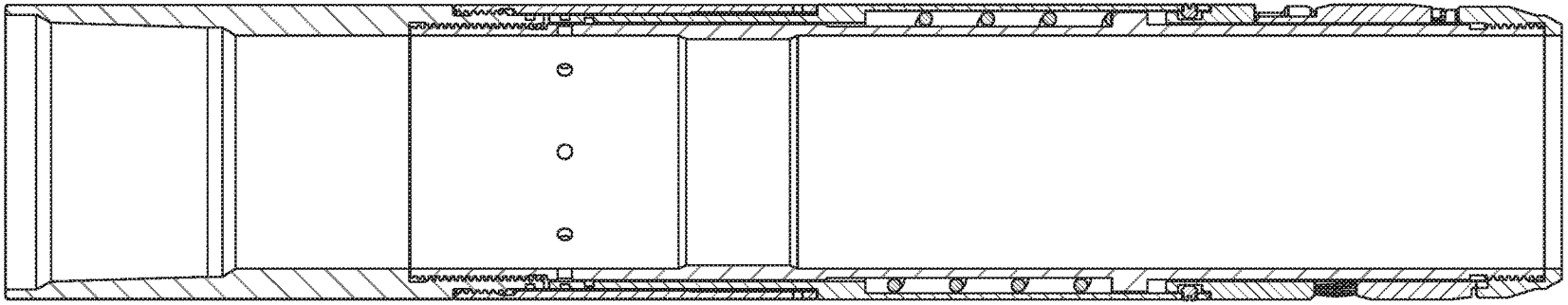
FIG. 6 is a section view of the nose in the collapsed position.
Figure 7:
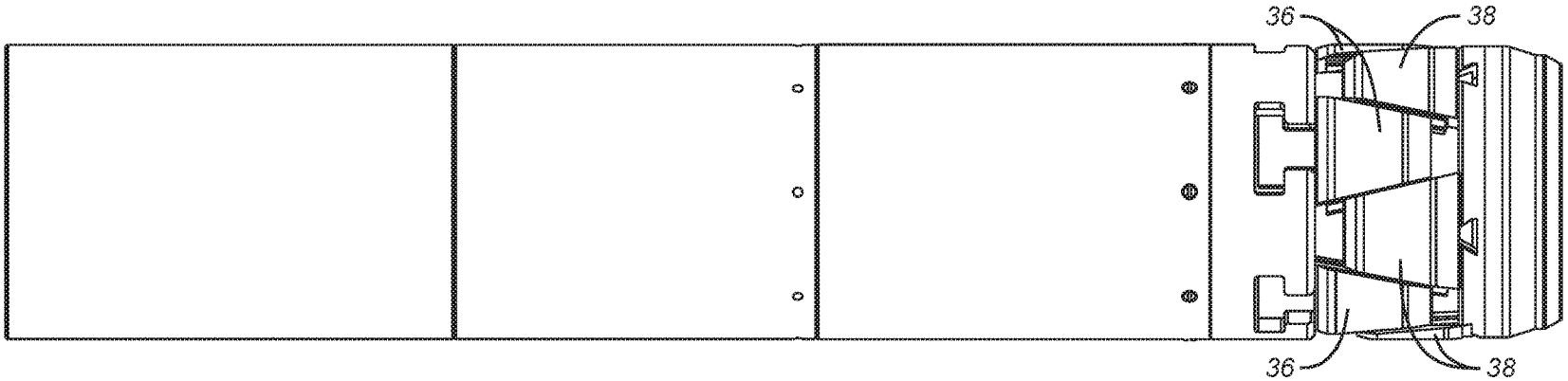
FIG. 7 is an external view of FIG. 6 showing the opposed tapered segments axially pulled apart for the smaller nose diameter.
Figure 8:
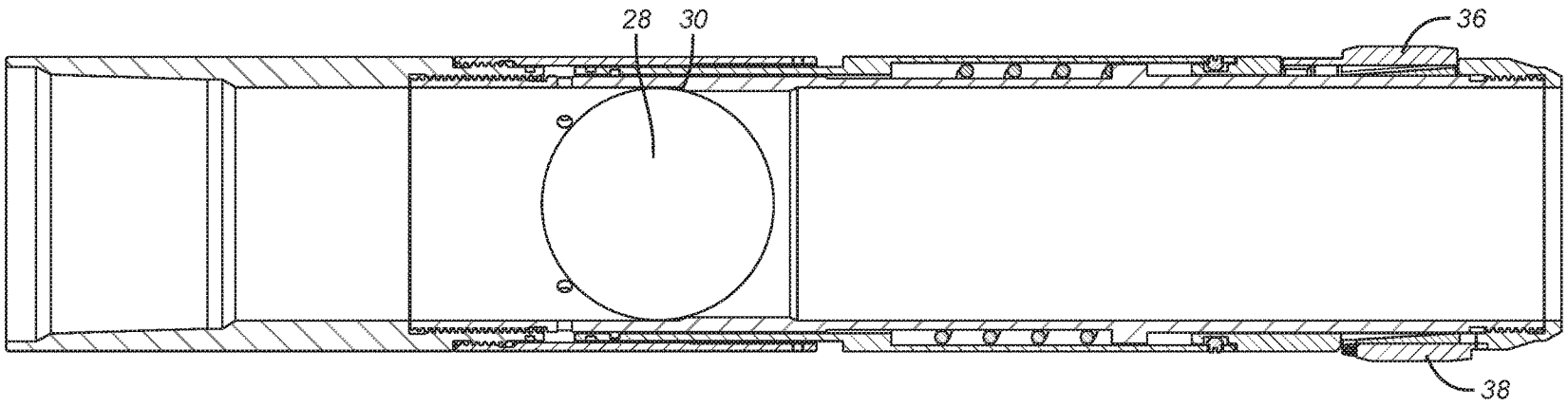
FIG. 8 is the view of FIG. 6 with pressure applied to a seated ball to move the axially oriented segments toward each other for the larger nose dimension.
Figure 9:
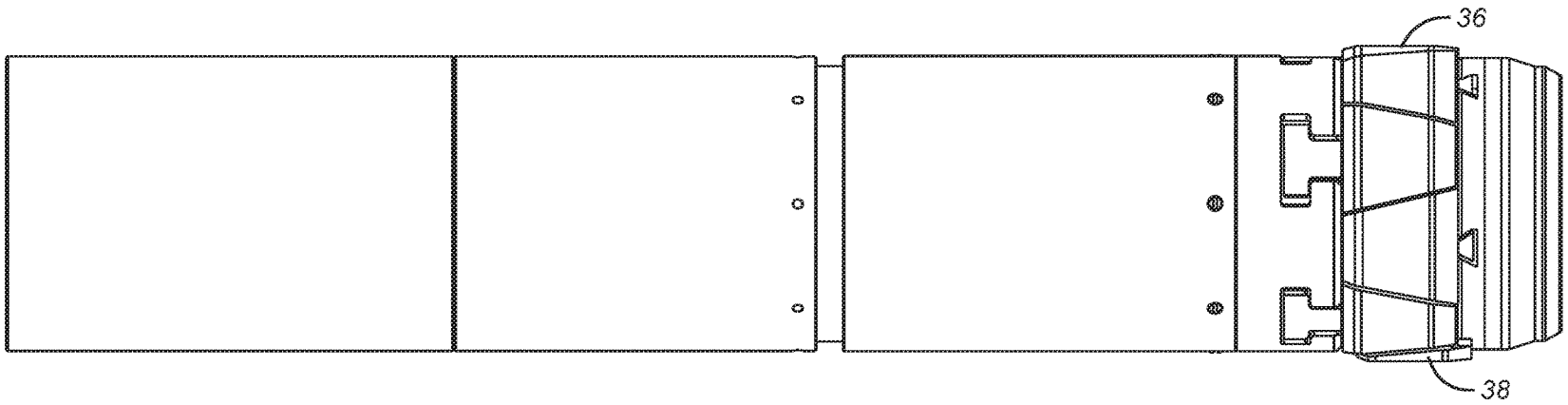
FIG. 9 is an external view of the nose shown in FIG. 8.

At the conclusion of the treatment in the main bore 10 the string 22 is picked up to the FIG. 3 position near the upper end 26 of the diverter 14. At this time a ball or other object 28 is landed on seat 30 and pressure on ball 28 is directed to lateral ports 32 to push down on piston 34 to move segments 38 axially relative to segments 36 from the FIG. 7 to the FIG. 9 position. As seen in FIGS. 6 and 8, the ring formed by dovetailed segments 36 and 38 has increased in diameter between FIGS. 6 and 8. At that increased diameter the nose assembly 24 cannot go through opening 16 but can advance in the lateral 12 through the diverter 14. Accordingly, string 22 is advanced to the FIG. 3 position to the FIG. 3*a* position with segments 36 and 38 extended until the segments 36 and 38 reach a first no-go 40 at which time the seal stack 20 will be above the seal bore 18. At this time the pressure will be raised against ball or object 28 to blow it through seat 30 to open a passage 42 through the nose assembly 24 so that treatment of lateral 12 can take place in a known manner after the nose assembly 24 is configured to its smaller dimension and seal stack 20 is advanced into seal bore 18 which occurs after hitting the second no-go 41.

The ring formed by segments 36 and 38 can be enlarged and allowed to collapse to a smaller dimension several times so that treatment of multiple laterals off a main bore can be accomplished in a single trip without need to pull out of the hole. While the treatment can proceed in any order, the preferred order is to treat the main bore zone first and then sequentially one or more laterals in a top down or bottom up order.

While the mechanism that changes the diameter of the nose assembly between two diameters can vary, the preferred design allows for an open passage for treatment after proper placement and a configuration that properly locates a seal stack in a seal bore either in the main bore or in one or more laterals. Preferably the segments 36 and 38 can be brought to the smaller dimension for initial running in and for pulling out of the hole. The segments can be moved between positions in a manner described in U.S. Pat. No. 7,128,146 whose contents are incorporated by reference herein as if fully set forth. The order of operation can be varied so that the lateral is treated with the nose enlarged before the main bore connected to the same diverter. Enlarging the nose prevents passage through the opening in the main bore through the diverter but still allows the nose into the lateral. Reducing the nose diameter allows through passage to the main bore via opening 16.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

The above description is illustrative of the preferred embodiment and many modifications may be made by those skilled in the art without departing from the invention whose scope is to be determined from the literal and equivalent scope of the claims below:

We claim:

1. A one trip treating method for a first bore and at least one interconnected second bore through a diverter, comprising:

passing a nose assembly at a string leading end through a first diverter opening and into the first bore with said nose assembly in a smaller diameter configuration;

performing a first treatment through an open central axial passage defined within the nose assembly and an axial end opening in said nose assembly;

retracting said nose assembly through said first diverter opening;

providing an object on a seat in said passage of said nose assembly to change configuration of said nose assembly with pressure in said string, said object being a ball;

reconfiguring said nose assembly to a larger diameter configuration such that passage of said nose assembly through a second diverter opening in the second bore.

2. The method of claim 1, wherein:

the step of providing the object on the seat temporarily closes said central axial passage for reconfiguring said nose assembly between said smaller and larger configurations.

3. The method of claim 1, comprising:

providing seal bores in said first and second bores;

engaging said seal bores with a seal stack on said string.

4. The method of claim 1, comprising:

moving a piston axially with said pressure;

axially shifting spaced segments of a ring shape with respect to other segments defining the ring shape to change the diameter of said ring shape.

5. The method of claim 4, comprising:

overcoming a bias on said piston with said moving said piston.

6. The method of claim 1, comprising:

forcing said object through said seat to reopen said passage in said nose assembly after placement of said nose assembly while in the larger configuration in the second bore.

7. The method of claim 1, comprising:

contacting a first no-go in said second bore with said nose assembly when in the larger configuration;

opening said passage in said nose assembly after contacting said first no-go in said second bore;

reconfiguring said nose assembly to said smaller configuration before further advancing said nose assembly to a second no-go to place a seal stack on said string in a seal bore of said second bore.

8. The method of claim 7, comprising:

pulling said nose assembly out of said second bore and to a surface location in said smaller configuration.

9. The method of claim 1, comprising:

performing fracturing as said first treatment.

* * * * *